US012385268B2

(12) United States Patent
Stafford

(10) Patent No.: US 12,385,268 B2
(45) Date of Patent: Aug. 12, 2025

(54) MAGNETIC SPACER ASSEMBLY FOR METAL FRAME CONSTRUCTION

(71) Applicant: NABHOLZ CONSTRUCTION CORPORATION, Conway, AR (US)

(72) Inventor: Joshua Ray Stafford, Collinsville, OK (US)

(73) Assignee: Nabholz Construction Corporation, Conway, AR (US)

( * ) Notice: Subject to any disclaimer, the term of this patent is extended or adjusted under 35 U.S.C. 154(b) by 56 days.

(21) Appl. No.: 18/139,677

(22) Filed: Apr. 26, 2023

(65) Prior Publication Data

US 2024/0360686 A1 Oct. 31, 2024

(51) Int. Cl.
*E04G 25/06* (2006.01)
*E04G 25/04* (2006.01)
*E04G 25/00* (2006.01)

(52) U.S. Cl.
CPC ..... *E04G 25/061* (2013.01); *E04G 25/065* (2013.01); *E04G 2025/003* (2013.01); *E04G 25/04* (2013.01)

(58) Field of Classification Search
CPC ..... E04G 25/04; E04G 25/061
USPC ..... 248/351, 354.1, 354.3, 354.4, 354.5, 248/354.6, 309.4, 206.5
See application file for complete search history.

(56) References Cited

U.S. PATENT DOCUMENTS 498,563 A 5/1893 Montgillion
3,292,328 A 12/1966 Lewis et al.
3,317,173 A * 5/1967 Williams ..... E04G 25/04 248/351
3,852,935 A 12/1974 Jones
3,880,394 A * 4/1975 Wisecarver ..... E04G 25/065 410/151
4,237,669 A 12/1980 Hunter
4,658,556 A 4/1987 Jenkins
5,746,329 A * 5/1998 Rondeau ..... E04H 15/64 211/DIG. 1
5,813,647 A * 9/1998 Chen ..... B60P 7/15 410/151
6,050,045 A 4/2000 Campbell
6,164,028 A 12/2000 Hughes
6,217,015 B1 * 4/2001 Kulla ..... E04G 21/1841 269/208
6,839,974 B1 * 1/2005 Hitchcock ..... B43L 7/12 33/DIG. 1

(Continued)

*Primary Examiner* — Alfred J Wujciak
(74) *Attorney, Agent, or Firm* — Hall Estill Law Firm

(57) ABSTRACT

Apparatus and method for temporarily supporting metal framing members during construction of a metal frame structure. A spacer tool has a main body portion with an outer tube and a first support plate at one end, and an extendable portion with an inner tube and a second support plate at an opposing end. The inner tube is slidably retractable and extendable within the outer tube to establish an overall separation distance between the first and second support plates via a locking assembly. Each of the first and second support plates includes at least one magnet to enable the support plates to be magnetically secured to each of the adjacent metal framing members during installation thereof. For example, a first metal stud can be secured, and the spacer tool can be used to position and support a second metal stud for installation at the desired spacing from the first stud.

15 Claims, 4 Drawing Sheets

(56) References Cited

U.S. PATENT DOCUMENTS

| | | | | |
|---|---|---|---|---|
| 7,490,813 | B1 * | 2/2009 | Weddle | B66F 3/24 248/354.1 |
| 7,950,615 | B2 * | 5/2011 | Lu | F16B 7/14 410/151 |
| 9,103,108 | B2 | 8/2015 | Lin | |
| 10,132,427 | B1 * | 11/2018 | Park | F16L 1/09 |
| 2004/0081518 | A1 * | 4/2004 | Stankus | E21D 15/325 248/354.1 |
| 2007/0234671 | A1 | 10/2007 | Klein | |
| 2009/0050771 | A1 * | 2/2009 | Horne | E04G 25/061 248/354.5 |
| 2019/0234038 | A1 * | 8/2019 | Wood | E04G 25/04 |

* cited by examiner

MAGNETIC SPACER ASSEMBLY FOR METAL FRAME CONSTRUCTION

BACKGROUND

Metal framing members are commonly employed in various types of residential and commercial construction. The framing members can take a variety of forms, such as metal studs (e.g., spaced apart vertical beams used to support walls) and metal joists (e.g., spaced apart horizontal beams used to support ceilings and/or floors). Metal studs and joists are often formed of channel shaped, cold-rolled steel with typical thicknesses in the 16 to 18 gauge range. A c-shaped channel is usually provided, but other structurally reinforcing shapes can be used as well.

Metal studs, joists and other metal framing members are sometimes supplied in sizes that correspond to sizes used for dimensional lumber. For example, a conventional 2×4 metal stud may have nominal width and thickness dimensions of about 3½ inches (in.) by about 1⅝ in., and will have an extended length such as on the order of about 108 in. (9 feet). Other sizes can be provided and used.

Metal framing members provide a number of advantages over conventional wood construction. As a rule, metal framing members tend to have lower weight than, and are often less expensive than, corresponding wood framing members. Metal framing members are generally straighter, easier to install, can include knockouts and channels that facilitate interwall routing such as plumbing and electrical wiring, and tend to be resistant to insect and water damage.

A disadvantage with metal framing members is their flexibility. While metal framing members are exceptionally rigid and capable of supporting high bearing loads once installed, prior to installation the members can be relatively flimsy and easily damaged or deformed. Metal framing members also have a tendency to twist, particularly for longer members such as studs and truss components.

SUMMARY

Various embodiments of the present disclosure are generally directed to systems and methods for placing and supporting metal frame construction members during installation. While metal stud wall framing is contemplated as a particularly suitable form of metal framing assembly with which various embodiments can be utilized, substantially any form or type of light-gauge metal members are appropriate and can be processed in accordance with the principles disclosed herein, including but not limited to floors, ceilings, and roof assemblies.

In some embodiments, an apparatus in the form of a spacer tool is provided to temporarily support a pair of adjacent metal framing members during construction of a metal frame structure. The spacer tool includes a main body portion comprising an outer tube with opposing first and second ends, a first support plate affixed to the first end of the outer tube, and a locking assembly coupled to a sidewall of the outer tube. The spacer tool further has an extendable portion comprising an inner tube with opposing first and second ends and a second support plate affixed to the second end of the inner tube. The first end of the inner tube is insertable into the second end of the outer tube so that the inner tube is slidably retractable and extendable relative to the outer tube. The locking assembly is configured to contactingly engage a sidewall of the inner tube to establish a selected overall separation distance between the first and second support plates. Each of the first and second support plates includes a magnet that generates a magnetic retention force to secure the corresponding first or second support plate against a corresponding one of the pair of adjacent metal framing members during installation thereof.

In further embodiments, a method is provided for temporarily supporting spaced apart first and second metal framing members during construction of a metal frame structure. The method includes steps of adjusting a spacer tool to a selected overall length, the spacer tool comprising a main body portion comprising an outer tube with opposing first and second ends, a first support plate affixed to the first end of the outer tube, and a locking assembly coupled to a sidewall of the outer tube, the spacer tool further comprising an extendable portion comprising an inner tube with opposing first and second ends and a second support plate affixed to the second end of the inner tube, the first end of the inner tube insertable into the second end of the outer tube so that the inner tube is slidably retractable and extendable relative to the outer tube, the spacer tool adjusted to the selected overall length by using the locking assembly to engage a sidewall of the inner tube to establish a the selected overall length as an overall separation distance between the first and second support plates, each of the first and second support plates comprising a magnet; securing the first metal framing member in a selected, fixed orientation relative to the metal frame structure; contactingly engaging a selected one of the first or second support plate against a web portion of the first metal framing member so that a first magnetic retention force is established between the selected one of first or second support plate via the magnet therein and the first metal framing member; bringing a web portion of the second metal framing member into contacting engagement with a remaining one of the first or second support plates so that a second magnetic retention force is established between the remaining one of first or second support plate via the magnet therein and the second metal framing member, the first and second magnetic retention forces sufficient to support the spacer tool; securing the second metal framing member in a selected, fixed orientation relative to the metal frame structure while the first and second magnetic retention forces continue to support the spacer tool; and subsequently removing the spacer tool by disengaging the first and second support plates from the first and second metal framing members.

These and other features and advantages of various embodiments can be understood from a review of the following detailed description in conjunction with a review of the accompanying drawings.

DETAILED DESCRIPTION

Various embodiments of the present disclosure are generally directed to systems and methods for supporting metal framing components, such as but not limited to metal studs, joists, trusses, etc., during the construction of a metal frame building structure.

As explained below, some embodiments provide a novel level and spacer tool, also sometimes referred to as a magnetic spacer assembly, which is useful in establishing a desired spacing between adjacent metal framing members. The tool has a main body with a retractable and extendable arm that allows the tool to be set to a desired template width. Support plates are provided at each end of the tool and include magnets to enable the tool to contactingly engage and support the adjacent metal framing members.

The metal framing members may take the form of metal studs used during wall construction. The studs can be any shape, but typically are c-shaped and all face in a common direction at a predetermined spacing, such as nominally 16 in. apart, along an interior or exterior wall section. In this case, the plates fit within the interior of one stud and the exterior of the next adjacent stud to establish the desired support and spacing during installation. The magnetic retention ensures stable engagement and positioning, allowing the tool to be used at the base of the framing members or at an intermediate, elevated location. Once the tool is engaged, the user is free to install one or more fasteners to secure the member in the desired location.

Locking mechanisms such as spring-biased plungers can be used to set the tool at a desired predetermined length (e.g., 16 in., 24 in., etc.). Adjustable mechanisms such as set screws can additionally be used to set the tool at non-standard lengths within the overall adjustment range of the tool. Additional features can include one or more bubble/laser levels, a magnetic bit/fastener tray, a user handle, etc. In this way, the tool can be used by a single worker to position and support a metal framing member in an accurate and stable orientation during installation without the need for a second worker or other mechanism to stabilize the member.

Figure 1:
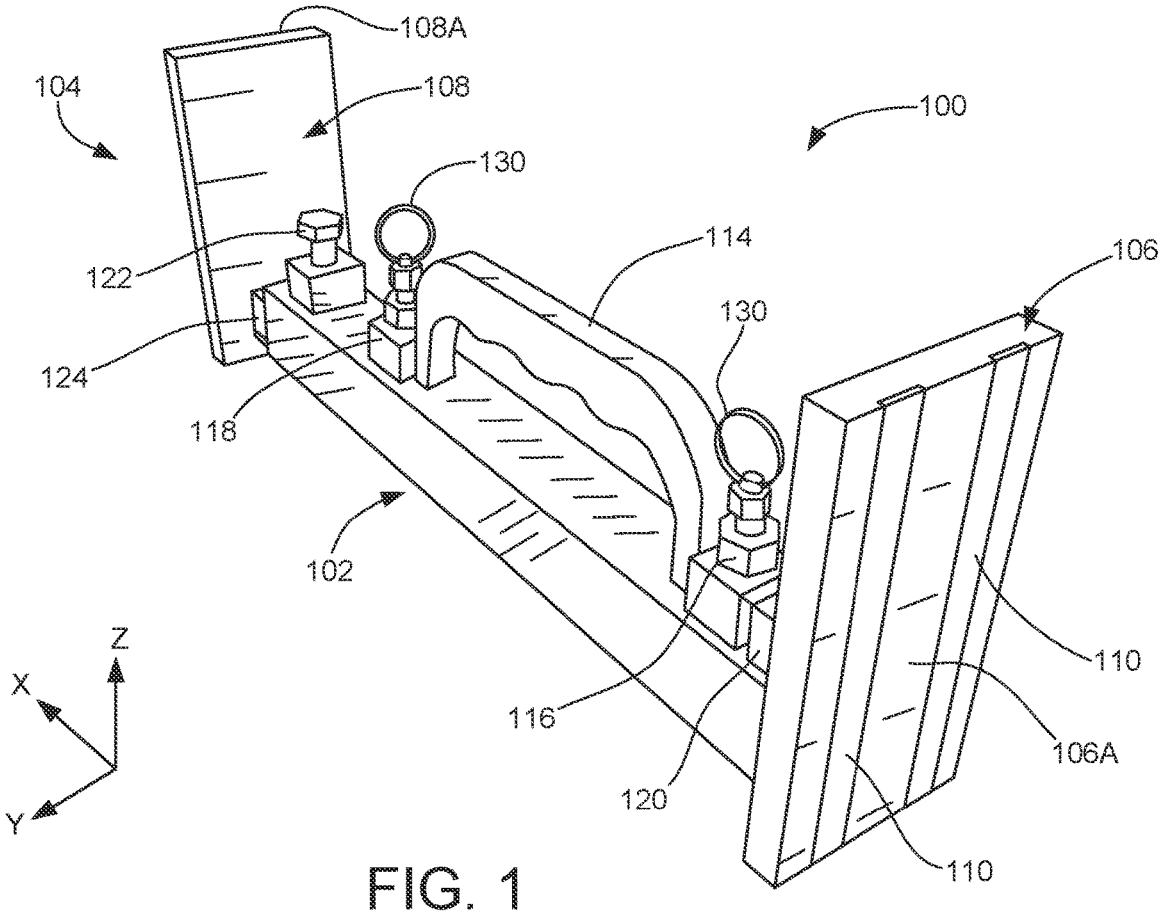
FIG. 1 is a perspective representation of a magnetic spacer assembly constructed and operated in accordance with various embodiments of the present disclosure.

These and other features and advantages of various embodiments can be understood beginning with a review of FIG. 1 which provides a perspective end view of a magnetic spacer assembly 100. The magnetic spacer assembly 100, also sometimes referred to as a spacer and level tool or a spacer tool, includes a main body portion 102 and an extendable portion 104.

The extendable portion 104 can be characterized as an arm that is telescopically extendable from, and retractable into, the main body portion 102. This operation establishes an overall length (spacing) for the tool 100 along an X direction (see FIG. 1). The respective portions 102, 104 can be formed of magnetic or non-magnetic metal including steel, aluminum, etc. The tool or portions thereof can alternatively be made of injection molded plastic, nylon, elastomeric material, or any other sufficiently rigid material.

Metal frame support plates 106, 108 are provided at each end of the tool 100, with the plate 106 rigidly affixed to the main body portion 102 and the plate 108 rigidly affixed to the extendable portion 104. In the example shown in FIG. 1, each plate 106, 108 is nominally identical to the other. Both plates are rectangular in shape with a width of about 3 in. (Y direction) and a height of about 6 in. (Z direction). This is merely exemplary and is not limiting, as the plates can have various shapes and sizes as required, including a configuration where one plate is differently sized or otherwise configured from the other.

Magnets 110 are incorporated into outwardly facing surfaces 106A, 108A of each of the plates 106, 108 to provide a magnetic attraction force to the adjacent metal framing members. The magnets can be of any suitable form and magnetic material, including rare earth magnets, bar magnets, etc., provided sufficient magnetic retention force is provided to enable the tool 100 to be supported thereby. The magnets 110 may be inlaid into the plates 106, 108 as shown.

A variety of alternative configurations are envisioned for the plates 106, 108, depending upon the requirements of a given operational environment. The outermost surfaces of the magnets 110 can be aligned with the plate surfaces 106A, 108A as shown so that both the plate surfaces 106A, 108A and the magnets 110 respectively contact the adjacent metal framing members. Alternatively, the magnets 110 can be recessed within, or protrude beyond, the outermost plate surfaces 106A, 108A. A magnetically permeable material can be used for the respective end plates 106, 108 to enhance the magnetic attraction. In still further alternatives, the magnets 110 can be encapsulated or otherwise embedded within the plates 106, 108. The magnets may even take the form of electro-magnets as desired.

A user handle 114 extends upwardly from a medial location along the main body portion 102 and is adapted to be gripped by a hand of a user during placement of the tool 100. While the overall weight of the tool 100 will depend upon a number of factors including size and material composition, it is contemplated that the tool will be sufficiently wieldy to enable the user to lift and precisely place the tool 100 using one hand.

Spring activated plunger assemblies are denoted at 116, 118 on opposing sides of the handle 114, and set screw assemblies 120, 122 are provided at each end of the main body portion 102. These respective assemblies enable the user to set the tool 100 to a desired overall length in a manner discussed below.

Figure 2:
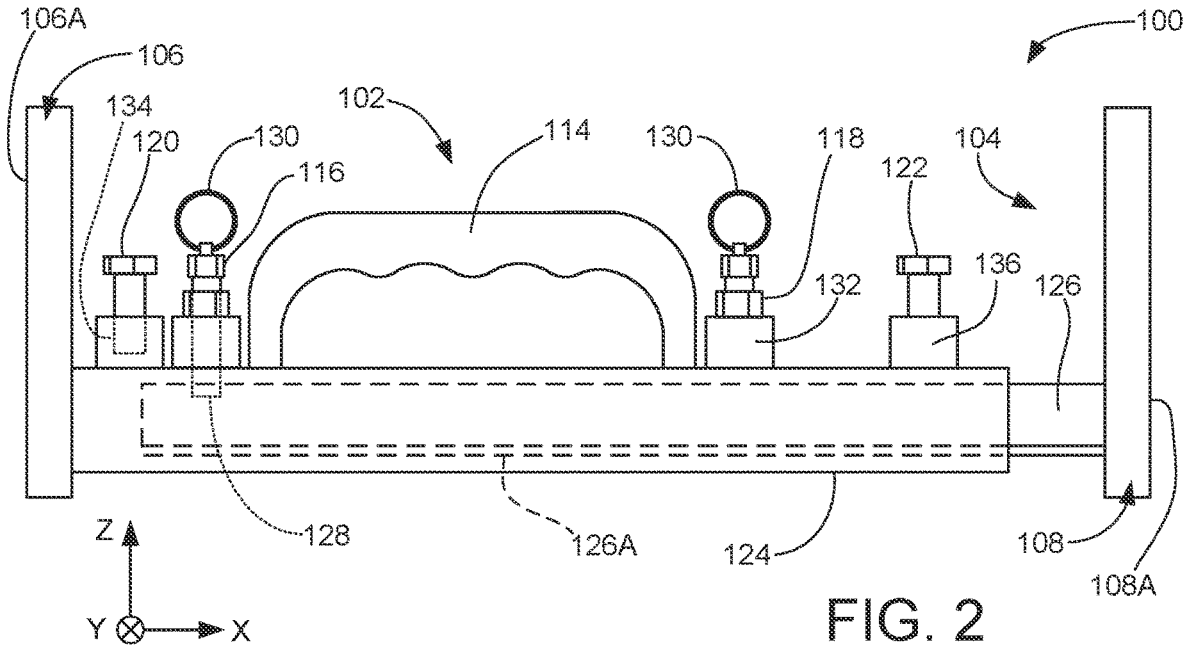
FIG. 2 is a side-elevational representation of the assembly of FIG. 1.

FIG. 2 is a side-elevational depiction of the tool 100 from FIG. 1. The main body portion 102 is shown to include a rectangular, elongated outer tube 124 which is open at a distal end opposite the plate 106. The extendable portion 104 likewise includes a rectangular, elongated inner tube 126 which telescopically engages the opening within the outer tube 124. In this way, the inner tube 126 can be slidingly inserted into the outer tube 124 to shorten the overall length of the tool 100, and can be slidingly retracted from the outer tube to extend the overall length of the tool.

While not limiting, in some embodiments the outer tube 124 can be formed from 1.5 in. square metal tube stock, and the inner tube 126 can be formed from 1 in. square metal tube stock. As desired, an alignment plate 126A can be attached to a lower portion of the inner tube 126 to provide keyed alignment of the inner tube 126 within the outer tube 124. Other keying arrangements can be used as described below.

Each of the spring-biased plunger assemblies 116, 118 includes an interior plunge pin 128 and an exterior user activation ring 130. An interior spring (not separately shown) biases each plunge pin 128 downwardly for mating engagement against or with the inner tube 126. The plunger assemblies 116, 118 each extend through support blocks 132 affixed to the outer tube 124.

Each of the set screw assemblies 120, 122 includes a set screw 134 with a standard sized bolt head and threaded shaft. This allows each set screw to be threadingly advanced and retracted in the Z direction by the user with the aid of appropriate tool (e.g., a wrench, socket, etc.). When fully advanced, the end of the set screw contactingly engages an upper sidewall surface of the inner tube 126 at substantially any exposed location along the length thereof. As with the plunger assemblies 116, 118, the set screw assemblies 120, 122 extend through support blocks 136 affixed to the upper surface of the outer tube 124.

Figure 3:
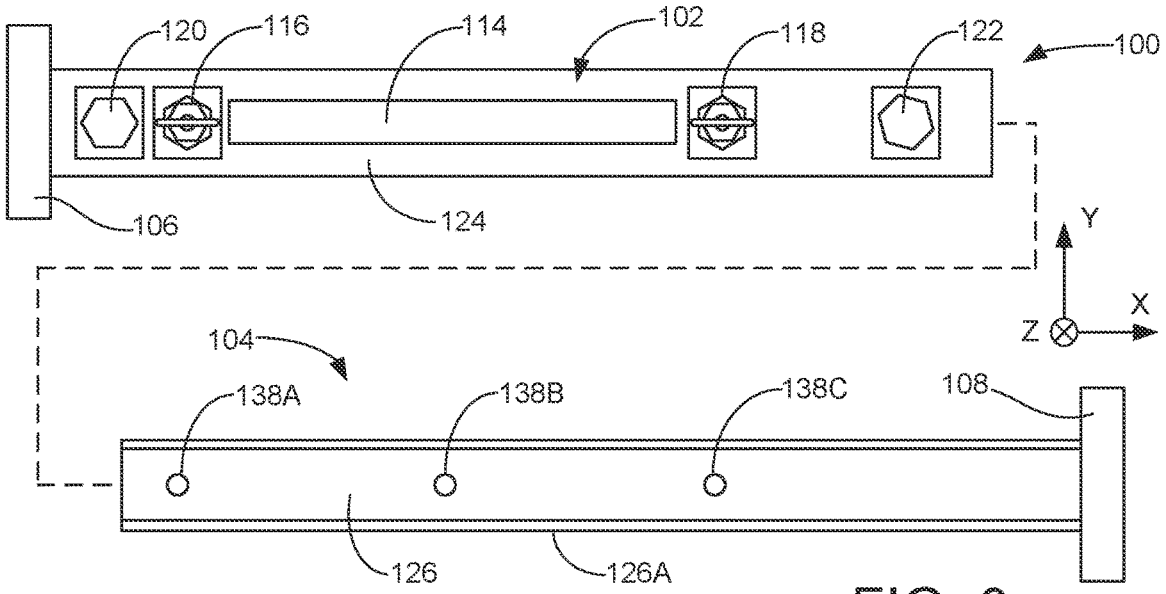
FIG. 3 is an exploded, top-plan view of the assembly.

FIG. 3 is a top plan representation of the tool 100 in accordance with further embodiments. The extendable portion 104 is shown in a fully removed orientation from the main base portion 102 to illustrate a series of apertures 138A, 138B and 138C that extend through a top sidewall surface of the inner tube 126. The apertures 138A-C can be located at any suitable locations for engagement by the plungers 128 to lock the tool 100 at various predefined length settings. Other numbers and arrangements of the apertures can be used.

Figure 4A:
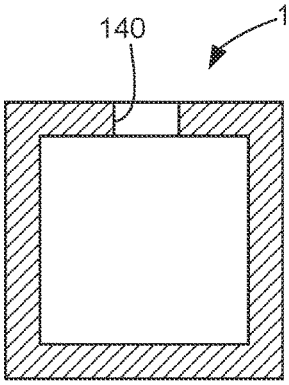
FIGS. 4A and 4B are cross-sectional views of telescopic tube portions from FIG. 3 in some embodiments.

FIG. 4A is a cross-sectional representation of the end of the outer tube 124 in some embodiments. A series of apertures 140 are provided through the top sidewall of the outer tube 124 to allow passage of the respective plunge pins 128 and set screws 134 discussed above in FIG. 2. The apertures 140 are aligned with corresponding through-apertures in the respective support blocks 132, 136 (FIG. 2).

Figure 4B:
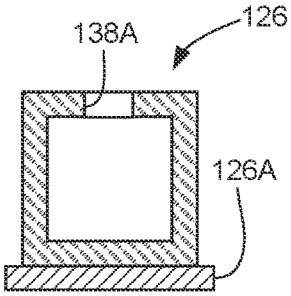

FIG. 4B is a corresponding cross-sectional representation of the inner tube 126 in some embodiments. The first aperture 138A from FIG. 3 is shown, as is the lower support plate 126A from FIGS. 2-3. It will be appreciated that the arrangement in FIG. 4B is sized to fit within the central opening in FIG. 4A. As with the aperture 140 in FIG. 4A, each of the apertures 138A-C extend through the top sidewall of the inner tube 126.

Figure 5A:
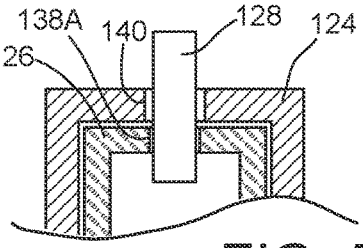
FIGS. 5A through 5C are cross-sectional views of the telescopic tube portions showing different locking assembly configurations that can be utilized in accordance with different embodiments.

FIG. 5A shows the engagement of a selected one of the plunge pins 128 from FIG. 2 through the aperture 140 in the outer tube 124 and through the aperture 138A in the inner tube 126. In this way, the inner tube 126 is locked at a predetermined extension distance with respect to the outer tube 124 along the X direction, since the distal end of the plunge pin 128 engages the sidewall of the inner tube 126 and prevents axial movement of the inner tube with respect to the outer tube.

Figure 5B:
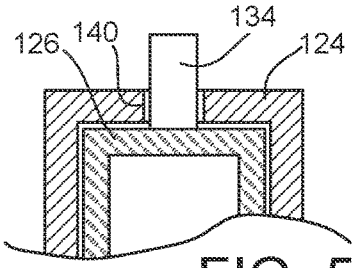

FIG. 5B shows the extension of a selected one of the set screws 134 through the aperture 140 in the outer tube 124 and into contacting engagement against the upper sidewall of the inner tube 126. The frictional force and mechanical interference supplied by the distal end of the set screw 134 prevents axial movement of the inner tube 126 with respect to the outer tube 124 as before. The set screw 134 can engage the upper sidewall of the inner tube 126 at substantially any position along the length thereof, allowing substantially any desired overall extension distance to be obtained.

The overall operational range of the tool 100 using the set screws 134 will be bounded by the minimum and maximum distances that the inner tube 126 can be slidingly retracted into or extended from the outer tube 124. For the particular tool shown in FIG. 3, the overall length of the outer tube 124 is about 14 in., the overall length of the inner tube 126 is about 15 inches, each of the plates are about ¾ in. in thickness, and the set screw 122 is about 2 in. from the end of the outer tube 124. This provides an effective adjustment range for the example tool 100 of from a minimum of about 15¾ inches to a maximum of about 27¾ in. The specific range will depend upon the actual configuration of the tool, so the above values are merely exemplary and are not limiting.

Figure 5C:
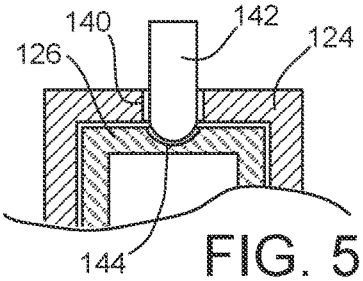

Other locking mechanisms can be used to secure the inner tube 126 with respect to the outer tube 124. FIG. 5C shows another embodiment in which a spring-biased plunge pin 142 similar to the pin 128 engages a detent 144 in the top sidewall of the inner tube 126. As before, the distal end of the pin 142 prevents axial movement of the inner tube 126 relative to the outer tube 124. It will be appreciated that the detent 144 is fairly characterized as an aperture similar to the apertures 138A-C, albeit the detent 144 does not extend fully through the thickness of the sidewall of the inner tube.

The curvilinear shape of the distal end of the plunge pin 142 and detent 144 allows the plunge pin to either be manually pulled upwardly to release using rings such as 130 in FIGS. 1-2, or allows the plunge pin to be retracted via application of force by the user to the respective plates 106, 108 to retract the pin and allow sliding movement of the respective tubes. In this latter case, a spring activated ball could be used as the plunge pin 142 in alternative embodiments. It will be appreciated that the distal ends of each of the plunge pin 128, the set screw 134 and the plunge pin 142 are also referred to as a pin member.

Figure 6:
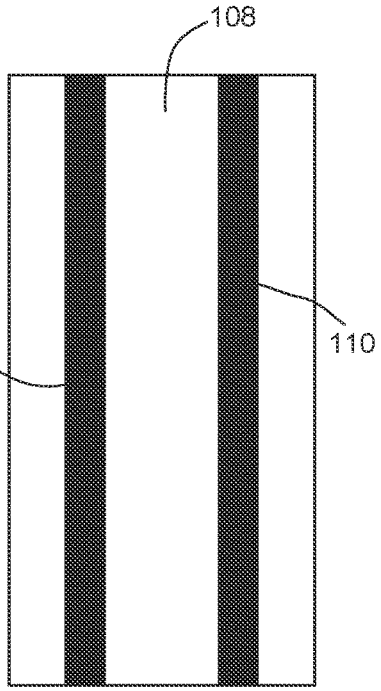
FIG. 6 is an end view of a selected one of the magnetic support plates of the assembly in some embodiments.

FIG. 6 is a side elevational view of the plate 108 of the extendable portion 104. As with the plate 106 shown in FIG. 1, the plate 108 has spaced apart magnets 110 adapted to secure the plate 108, and hence the full weight of the tool 100, against a vertical metal surface. Other configurations can be used for the respective plates 106, 108 as discussed above.

Figure 7:
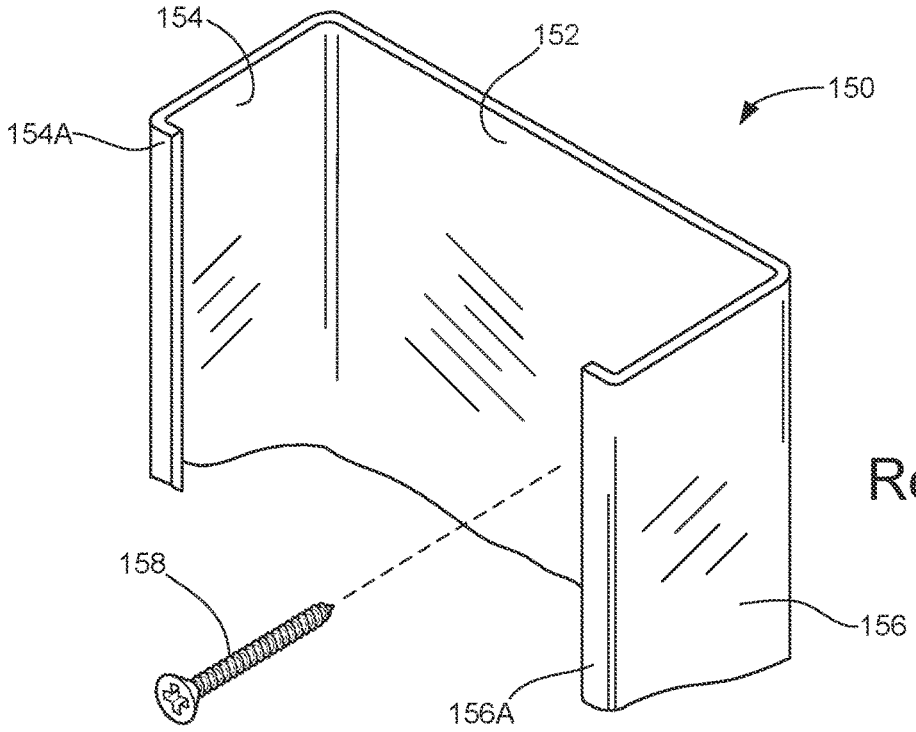
FIG. 7 Related Art
FIG. 7 depicts a portion of a metal framing member of the related art to illustrate an environment in which various embodiments can be advantageously practiced.

FIG. 7 shows a portion of a metal framing member 150 in the form of a c-shaped metal stud in accordance with the related art. The stud 150 has a central web 152 and opposing flanges 154, 156. The flanges 154, 156 are nominally orthogonal to the central web 152, and optionally terminate with secondary flanges 154A, 156A that extend inwardly parallel to the central web 152. This c-shaped channel configuration provides strength in the Z direction under load. While not limiting, it is contemplated that the stud 150 is a 2×4×9 metal stud with nominal dimensions of 3½ in. by 1⅝ in. by 108 in. (9 feet). Threaded fasteners such as 158 can be used to secure the stud 150 while held in place by the tool 100, as discussed in FIGS. 8A and 8B.

Figure 8A:
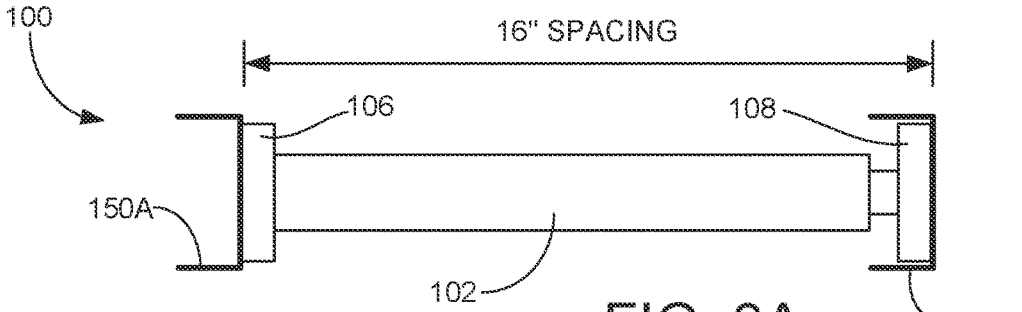
FIGS. 8A and 8B show different operational settings for the assembly in some embodiments.

FIG. 8A shows a simplified version of the tool 100 used to support a pair of the studs 150A, 150B at a nominal 16 in. spacing distance to frame an interior or exterior wall of a building structure. In some cases, a first stud is already secured in place, such as the stud 150A adjacent plate 106, and a second stud 150B is positioned by the user and held in place using the tool 100 via attachment to the plate 108.

From FIG. 8A it can be seen that the respective plates 106, 108 are configured to readily attach, via magnetic forces, to either the interior or the exterior surfaces of the central web 152 of the respective studs 150A, 150B (see FIG. 7). In this case, the extendable portion 104 is retracted within the main body portion 102 and locked (such as via the plunger assemblies 116, 118) to establish the appropriate spacing distance of 16 in. between the studs 150A, 150B.

Figure 8B:
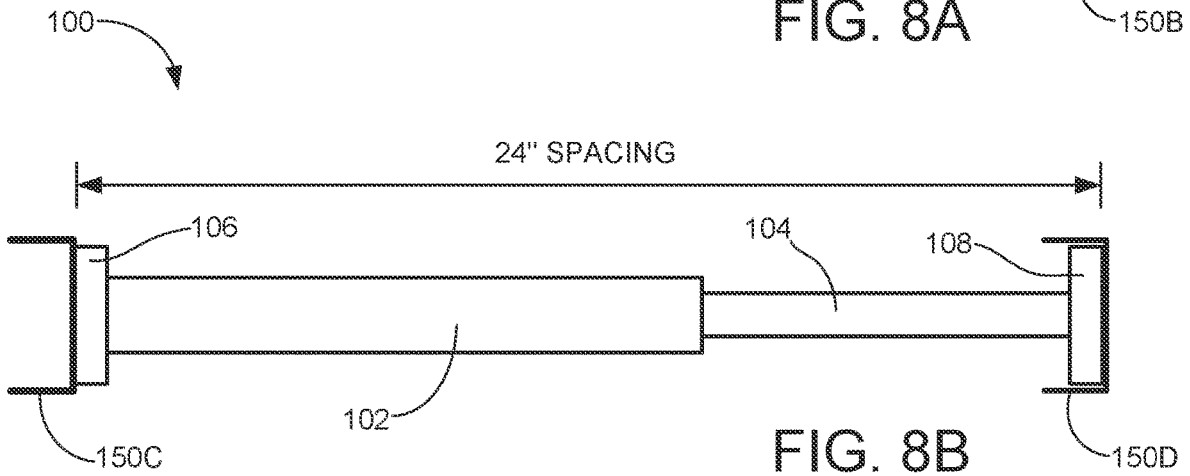

FIG. 8B shows the tool 100 in another configuration in which a 24 in. stud spacing is provided between adjacent studs 150C, 150D. In this case, the extendable portion 104 is extended from the main body portion 102 and locked into place using one or both of the plunger assemblies 116, 118 at the appropriate spacing distance of 24 in. This allows the tool 100 to engage a first stud (e.g., stud 150C) using the plate 106 and to position a second stud (e.g., stud 150D) onto the plate 108.

At this point it will be appreciated that the tool 100 can readily be used with different shapes, sizes and orientations of studs, joists, trusses, or other framing members as required. For example, it is not necessarily required that the framing members have c-shaped channels, or that all of the members be facing in the same direction as shown.

Figure 9:
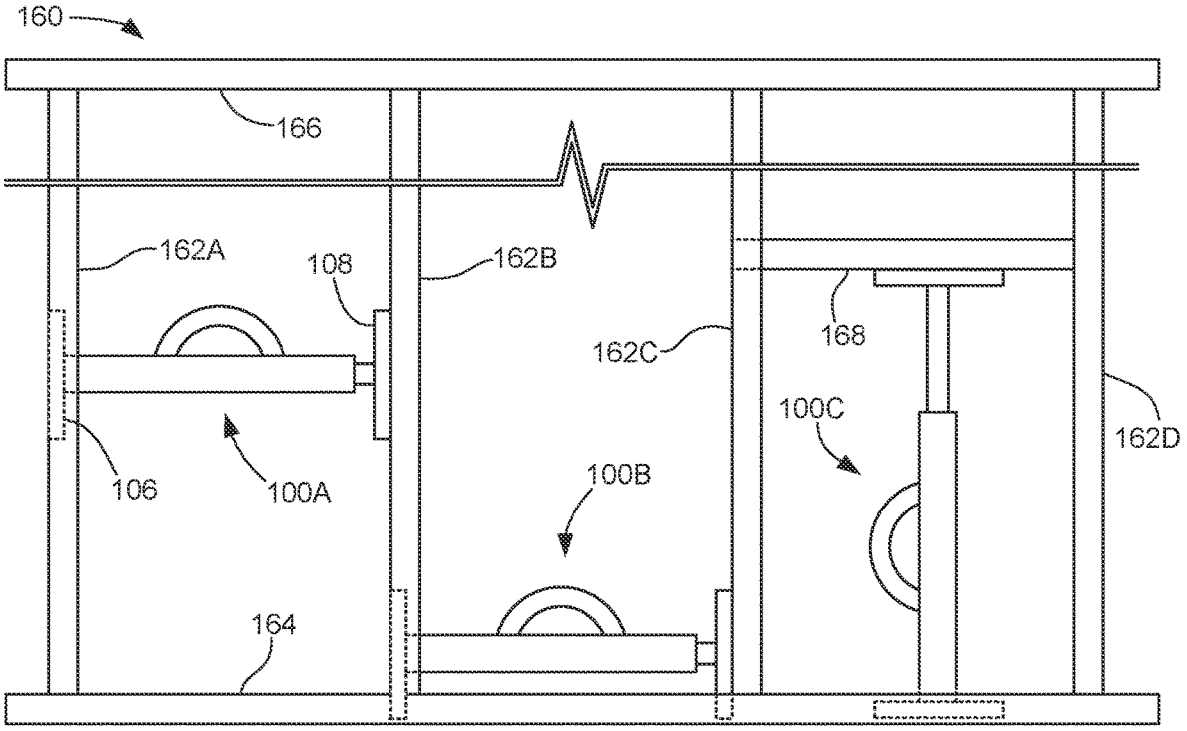
FIG. 9 depicts a structure formed of metal framing members to illustrate use of a spacer assembly in accordance with further embodiments.

FIG. 9 shows a simplified representation of a building structure 160 constructed with the aid of the spacer tool 100 in some embodiments. For clarity, the tool 100 is variously depicted as simplified versions 100A, 100B and 100C to show different orientations and placements in which the tool can be utilized as required.

The building structure 160 is contemplated as constituting a portion of an interior or exterior wall to which facia, such as in the form of drywall panels, will be subsequently attached. The structure 160 includes a number of vertically extending studs 162A, 162B, 162C and 162D supported by and within a horizontally extending base channel 164.

A second, upper channel is shown at 166, and extends in parallel fashion to the lower base channel 164 to secure the tops of each of the studs 162A-D. A horizontal bracing member is denoted at 168 and may be used as an additional support for the wall, as a portion of a window frame or other opening that will extend through the wall, etc.

The spacer tool as described above can be utilized in a number of ways to assist a single user in constructing the structure 160 in a fast and efficient manner. For example, tool 100A is shown to be supported at a selected elevation above the base channel 164, thereby supporting the respective adjacent studs 162A, 162B while the user installs fasteners such as 158 in FIG. 7 to affix these studs to the base channel 164 and the upper channel 166.

It is contemplated that in some embodiments, the magnetic retention force provided by each plate 106, 108 is sufficient to support the entirety of the tool. However, this is not necessarily required. In other embodiments, the combined magnetic retention force of both plates 106, 108 is more than sufficient to support the tool; hence, even if the tool cannot be supported by just the single stud 162A, it can be supported by both studs 162A, 162B and can provide sufficient rigidity to hold the second stud 162B in place prior to installation of the fasteners 158.

The tool 100B is shown to be at the ground level on base channel 164 to facilitate installation of a selected stud (in this case, stud 162C). It will be noted that the tool 100B has sufficient strength to maintain the installed stud in the desired vertical orientation and with sufficient rigidity to enable attachment to the base channel 164 as well as to the upper channel 166.

The tool 100C shows extension of the tool to a non-standard height, such as about 20 in., to support the horizontal brace member 168 at the desired location between studs 162C and 162D.

In each of these illustrative cases, the magnetic retention force is sufficiently high to enable the user to support the stud(s) or other framing members as well as the weight of the tool, as required. At the same time, the magnetic retention force is sufficiently low such that the tool can be subsequently removed without damage or deformation to the respective members.

While not separately depicted in FIG. 9, the tool 100 could readily be further used to lay out and secure a number of horizontally extending ceiling joists parallel to and in spaced-apart relation to the upper channel member 166, either prior to or after the construction of the wall portion shown in FIG. 9. Similarly, a number of trusses or other members of a roof assembly extending from or otherwise interconnected with the wall portion can be supported using the spacer tool as required.

Figure 10:
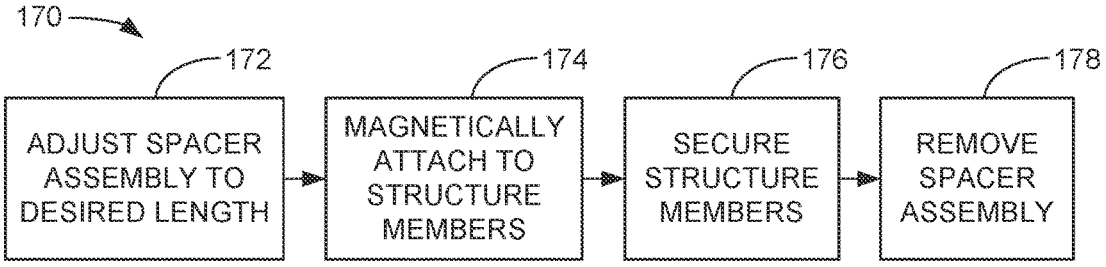
FIG. 10 is a sequence diagram to depict operative use of the spacer assembly such as in FIG. 9.

FIG. 10 shows an installation sequence to summarize various utilization steps for the tool 100 in constructing a metal frame structure such as the wall portion shown in FIG. 9. At block 172, the user adjusts the spacer assembly (tool) to the desired length. For reference, the desired length will be understood as the intervening distance between the outer facing surfaces of the respective plates 106, 108. For purposes of the present discussion, the studs in FIG. 9 are contemplated as being at a nominal 16 in. separation distance, so the tool 100 is adjusted to this effective length. Other distances, including non-standard distances, can be used.

Next, the user magnetically attaches the tool to one or more structure members at block 174. For example, in FIG. 9 this could include attaching the tool to a first stud that has been rigidly incorporated into the structure, such as stud 162A as shown by tool 100A. The user then maneuvers a second stud, such as stud 162B, into position so that the second stud is aligned in the proper location for installation. Part of this maneuvering operation will include contacting engagement of second stud against the non-supported plate (in this case, plate 108, as shown in FIG. 9).

Once aligned, the second stud is installed such as via threaded fasteners 158 at block 176. The tool (spacer assembly) is thereafter removed at block 178 for placement at the next desired location. Hence, while useful as aid in the construction of a structure, the tool does not become part of the resulting structure itself.

Figure 11A:
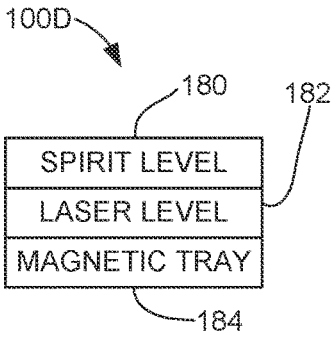
FIGS. 11A through 11D illustrate aspects of a spacer assembly in accordance with further embodiments to include various additional features such as levels, trays, keying features and multi-piece telescopic extensions.

FIGS. 11A through 11D show alternative configurations of the spacer tool that can be carried out in accordance with further embodiments. FIG. 11A shows relevant aspects of another tool 100D similar to the tools described above. In this case, various attachments are provided to the main body portion 102 including a spirit (bubble) level 180, a laser level 182 and a magnetic tray 184.

A spirit level such as 180 provides fluid and a bubble within an elongated sealed vial to enable the user to establish a true vertical or horizontal orientation. Such levels can be supplied along multiple axes (including all three of the X, Y and Z axes discussed herein and depicted in FIGS. 1-3) to aid in the alignment of the respective framing members.

The laser level 182 similarly provides leveling indications, this time by emitting a coherent beam of light at a selected wavelength (e.g., a laser) from a laser diode or similar electronic circuitry. As before, the laser beam can be provided along one or more desired axes.

The magnetic tray 184 is provided at a suitable location to attract and maintain magnetically permeable elements such as fasteners, drill bits, tools, etc. This can include the wrench used to adjust the set screws 134 (FIG. 2).

Figure 11B:
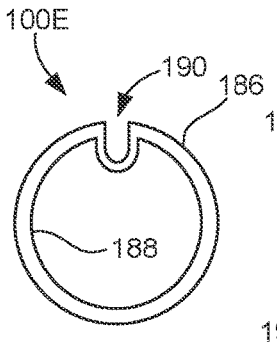

FIG. 11B depicts another spacer tool 100E. In this case, the respective main body portion 102 and extendable portion 104 operate as before, but this time are formed from round (circular) tube stock. Outer tube 186 generally corresponds to the outer tube 124 discussed above, and inner tube 188 generally corresponds to the inner tube 126 discussed above. Other cross-sectional shapes can be used, so FIG. 11B is merely exemplary and is not limiting.

A keying mechanism 190 can be provided to maintain the inner tube 188 in a desired rotational alignment with the outer tube 186. In this case, the keying mechanism uses a notch and channel (rail) arrangement, although other configurations can be used as desired.

Figure 11C:
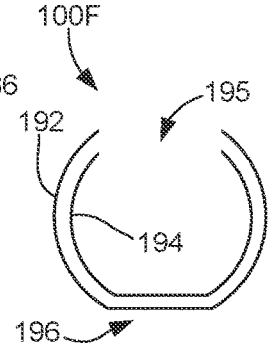

FIG. 11C shows aspects of yet another spacer tool 100F. The tool 100F also uses generally curvilinearly extending outer and inner tubes 192, 194 which operate to extend and retract as before. The tubes 192, 194 in FIG. 11C, however, are not fully enclosed as with the previous examples, but are rather open along channel 195 so as to take a sliding rail configuration. The tubes 192, 194 further take a general D-shape with flat portion 196 maintaining a desired rotational orientation of inner tube 192 with respect to outer tube 194.

Figure 11D:
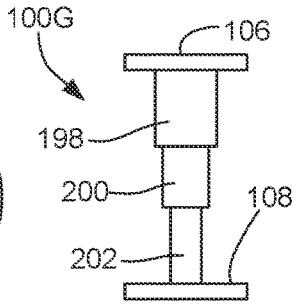

FIG. 11D shows a final spacer tool 100G. The tool 100G is similar to those described above, but include multiple telescopic elements 198, 200 and 202 that respectively collapse into and extend out of one another to expand the overall range of adjustability of the tool. In this case, the element 198 can generally correspond to the main body portion 102, the element 202 can generally correspond to the extendable portion 104, and element 200 can be an additional element that extends between the elements 198 and 202. Suitable locking elements, including set screws and plunge pins, can be provided as required to establish the final overall length of the tool 100G.

It will now be appreciated that the various embodiments presented herein can provide a number of advantages and benefits over the existing art. The magnetic retention capabilities of the various embodiments enable the tool to be securely affixed to the metal framing members for proper positioning and installation. The parallel nature of the respective support plates further ensures that the attached web portions of the corresponding studs or other metal framing members remain parallel and supported, thereby reducing twist and other undesired deformation.

The adjustability of the tool enable various standard and non-standard lengths and corresponding inter-member spacings to be established and maintained. Further features such as levels and utility trays can further enhance the usability of the device. A single worker can quickly and efficiently build a metal frame construction structure while minimizing the possibilities of deformation and damage to the flimsy unsupported metal members.

While the outer and inner tubes 124, 126 are shown as hollow members, such is not necessarily required; either or both can be filled or otherwise solid as desired, provided sliding retraction and extension can still take place as described herein.

For purposes of the appended claims, it will be understood that reference to various dimensions such as length, width and thickness are taken along orthogonal directions, but do not otherwise have any specific limitations other than those set forth by the claim language so that, for example, it is not necessarily required that the length be greater than the width, and so on.

It is to be understood that even though numerous characteristics and advantages of various embodiments of the present disclosure have been set forth in the foregoing description, this description is illustrative only, and changes may be made in detail, especially in matters of structure and arrangements of parts within the principles of the present disclosure to the full extent indicated by the broad general meaning of the terms wherein the appended claims are expressed.

What is claimed is:

1. An apparatus configured to temporarily support a pair of adjacent metal framing members during construction of a metal frame structure, the apparatus comprising:

a main body portion comprising an outer tube with opposing first and second ends, a first support plate affixed to the first end of the outer tube, and a locking assembly coupled to a sidewall of the outer tube; and an extendable portion comprising an inner tube with opposing first and second ends and a second support plate affixed to the second end of the inner tube, the first end of the inner tube insertable into the second end of the outer tube so that the inner tube is slidably retractable and extendable relative to the outer tube, the locking assembly configured to contactingly engage a sidewall of the inner tube to establish a selected overall separation distance between the first and second support plates, each of the first and second support plates comprising a magnet that generates a magnetic retention force to secure the corresponding first or second support plate against a corresponding one of the pair of adjacent metal framing members during installation thereof, wherein the apparatus is characterized as a spacer tool utilized to install spaced apart first and second metal framing members of the metal frame structure using a process comprising steps of:

adjusting the overall separation distance of the spacer tool to a selected distance;

securing the first metal framing member in a selected, fixed orientation relative to the metal frame structure;

contactingly engaging a selected one of the first or second support plate against a web portion of the first metal framing member so that a first magnetic retention force is established between the selected one of first or second support plate via the magnet therein and the first metal framing member;

bringing a web portion of the second metal framing member into contacting engagement with a remaining one of the first or second support plates so that a second magnetic retention force is established between the remaining one of first or second support plate via the magnet therein and the second metal framing member, the first and second magnetic retention forces sufficient to support the spacer tool;

securing the second metal framing member in a selected, fixed orientation relative to the metal frame structure while the first and second magnetic retention forces continue to support the spacer tool; and subsequently removing the spacer tool by disengaging the first and second support plates from the first and second metal framing members.

2. The apparatus of claim 1, wherein the locking assembly comprises a spring-biased plunge pin that extends through a first aperture through the sidewall of the outer tube and into a second aperture extending into the sidewall of the inner tube.

3. The apparatus of claim 1, wherein the locking assembly comprises a threaded set screw that extends through a first aperture through the sidewall of the outer tube and is brought into contacting engagement against a top surface of the inner tube.

4. The apparatus of claim 1, wherein the main body portion further comprises a user handle disposed at a medial position along the upper tube, the user handle configured to enable a user to place the apparatus between the pair of adjacent metal framing members for engagement therewith by the magnets in the first and second support plates.

5. The apparatus of claim 1, wherein the magnetic retention force supplied by the respective magnets in the first and second support plates is sufficient to support the apparatus at a nonzero elevational distance above a floor surface between the pair of adjacent metal framing members.

6. The apparatus of claim 1, wherein the inner tube comprises a plurality of spaced apart apertures configured to contactingly receive a distal end of a pin member of the locking assembly.

7. The apparatus of claim 1, wherein the plurality of spaced apart apertures includes at least one aperture sized and spaced to establish a first overall separation distance between the first and second support plates of nominally 16 inches, in.

8. The apparatus of claim 7, wherein the plurality of spaced apart apertures further includes at least one aperture sized and spaced to establish a second overall separation distance between the first and second support plates of nominally 24 inches, in.

9. The apparatus of claim 1, wherein the inner tube further comprises a keying mechanism that maintains the inner tube in a desired rotational orientation with respect to the outer tube during sliding movement of the inner tube within the outer tube.

10. The apparatus of claim 9, wherein the keying mechanism comprises at least a selected one of a plate affixed to the inner tube, a flat, or a channel.

11. The apparatus of claim 1, further comprising a bubble level affixed to a selected one of the main body portion or the extendable portion aligned along a selected axis.

12. The apparatus of claim 1, further comprising a laser level affixed to a selected one of the main body portion or the extendable portion aligned along a selected axis.

13. The apparatus of claim 1, further comprising a magnetic tray affixed to a selected one of the main body portion or the extendable portion.

14. The apparatus of claim 1, wherein each of the first and second support plates are formed of magnetically permeable material to which the associated magnets are attached.

15. The apparatus of claim 1, wherein each of the first and second support plates incorporate a plurality of magnets configured to establish magnetic securement of the first and second support plates to the corresponding pair of metal framing members.

* * * * *